US005584333A

United States Patent [19]

Torchetti et al.

[11] Patent Number: 5,584,333

[45] Date of Patent: Dec. 17, 1996

[54] RELEASABLE PANEL FOR OVERHEAD DOOR

[75] Inventors: Rinaldo Torchetti, Woodbridge; David R. McPhail, Norval; Bradley N. Cherkas, Kamsack, all of Canada

[73] Assignee: Super Seal Mfg. Ltd., Canada

[21] Appl. No.: 427,284

[22] Filed: Apr. 21, 1995

[51] Int. Cl.[6] ..... E05D 15/16

[52] U.S. Cl. ..... 160/201; 160/236

[58] Field of Search ..... 160/201, 236, 160/230, 133, 84.06, 273.1, 274, 275, 290.1, 327, 328, 354, 378, 270

[56] References Cited

U.S. PATENT DOCUMENTS

| | | | |
|---|---|---|---|
| 974,699 | 11/1910 | Ogden . | |
| 2,122,532 | 7/1938 | Mims et al. | 160/330 |
| 2,629,435 | 2/1953 | Dadswell . | |
| 2,815,808 | 12/1957 | Eckel | 160/354 |
| 3,140,508 | 7/1964 | Switzgable . | |
| 3,516,469 | 6/1970 | McDonald | 160/133 X |
| 3,870,391 | 3/1975 | Nims | 160/230 X |
| 4,016,920 | 4/1977 | Shepard | 160/133 |
| 4,122,887 | 10/1978 | Dussault et al. | 160/354 |
| 4,378,043 | 3/1983 | Sorenson | 160/201 X |
| 4,676,293 | 6/1987 | Hanssen . | |

OTHER PUBLICATIONS

Material Handling Engineering, Mar. 1995, "A Door Built to Take the Punches", p. 19.

*Primary Examiner*—Blair Johnson

*Attorney, Agent, or Firm*—Bachman & LaPointe, P.C.

[57] ABSTRACT

A panel member for use in an overhead door assembly has an outer frame defining a panel slot, with a swingable panel seated in the slot; the swingable panel is hingedly mounted to the outer frame by a hinge, retainers on the outer frame hold the swingable panel in the panel slot, however, under impact the panel is released from the retainers, whereafter it is free to pivot or swing about the hinge; after removal of the impact the swingable panel is snapped back into the retainers; the swingable panel thus accommodates impact forces which would otherwise dislodge the door from the track assembly.

20 Claims, 4 Drawing Sheets

RELEASABLE PANEL FOR OVERHEAD DOOR

BACKGROUND OF INVENTION i) Field of the Invention

This invention relates to a panel member for use in an overhead door assembly, to an overhead door assembly incorporating such a panel member and to an improved overhead door incorporating such a panel member.

ii) Description of Prior Art

Overhead doors employed in warehouses have a plurality of generally rigid panels arranged in a vertical linear array in which the edges of adjacent panels are flexibly coupled by hinges. The flexible coupling permits the door to be moved from a vertical orientation adjacent the door opening, which configuration closes the door opening, to an overhead horizontal configuration in which the door opening is open, along a pair of parallel tracks located at the sides of the door opening.

The parallel tracks include a vertical section adjacent the door opening, and an upper inclined or horizontal section with an intermediate curved or inclined section therebetween.

The door is guided along the tracks by rollers coupled to the door, particularly to the sides of the panels.

Overhead doors of this type are well known and as illustrative thereof there may be mentioned U.S. Pat. No. 974,699, U.S. Pat. No. 3,140,508 and U.S. Pat. No. 4,676,293, the teachings of which are incorporated herein by reference.

U.S. Pat. No. 4,676,293, David H. Hanssen, describes an overhead door of this type and offers a solution to one problem associated with such doors, namely, the problem of damage caused by impact of a moving vehicle, such as a forklift truck, with the door.

The solution in U.S. Pat. No. 4,676,293 is to have a bottom panel of the door detachably mounted, such that upon impact the bottom panel separates from its rollers becoming detached and physically displaced from the parallel tracks.

In practice difficulties are encountered in the practice of U.S. Pat. No. 4,676,293, in restoring the displaced bottom panel into engagement with the tracks and there are also difficulties in restoring the spring tension counterbalance assembly of the door, which may also suffer damage during the displacement of the bottom panel.

SUMMARY OF THE INVENTION

It is an object of this invention to provide a panel member for use in an overhead door assembly which includes a panel which is displaceable when subjected to an impact, but readily restored to its operative working position in the door assembly.

According to the invention there is provided a panel member for use in an overhead door assembly comprising: an outer frame, panel means receivable in said outer frame, hinge means hingedly mounting said panel means for pivotal movement relative to said outer frame, and retainer means on said outer frame to releaseably retain the hingedly mounted panel means in said outer frame, said panel means being releasable from said retainer means in response to a predetermined impact, such that said panel means is released from said retainer means and is permitted to pivotally move about said hinge means.

In accordance with one embodiment of the invention there is provided a panel member for use in an overhead door assembly comprising: an outer frame, panel means receivable in the outer frame, means hingedly mounting the panel means on the outer frame, and retainer means on the outer frame to retain the hingedly mounted panel means in the outer frame, the panel means restorably flexing in response to impact, to release the panel means from the retainer means and permit pivotal movement of the panel means about the hinge means.

In an especially preferred embodiment the hinge means is a flexible hinge means, and the flexible hinge means and the panel means restorably flex in response to impact, to release the panel means from the retainer means and permit swinging movement of the panel means about the hinge means.

In accordance with another aspect of the invention there is provided an overhead door assembly adapted for movement between a closed position and an open position on spaced apart parallel tracks comprising: a plurality of panels in side-by-side relationship, hinges between adjacent panels of said plurality, flexibly coupling adjacent panels, rollers associated with said panels and engaging said tracks and a bottom panel hingedly coupled to an adjacent panel in which the bottom panel is a panel member of the invention.

In still another aspect of the invention there is provided in an overhead door including a plurality of panels in which adjacent panels are flexibly coupled together for guidance along spaced apart, parallel guide tracks, the improvement wherein at least one of said panels is a panel member of the invention.

DESCRIPTION OF PREFERRED EMBODIMENTS WITH REFERENCE TO THE DRAWINGS

Figure 1:
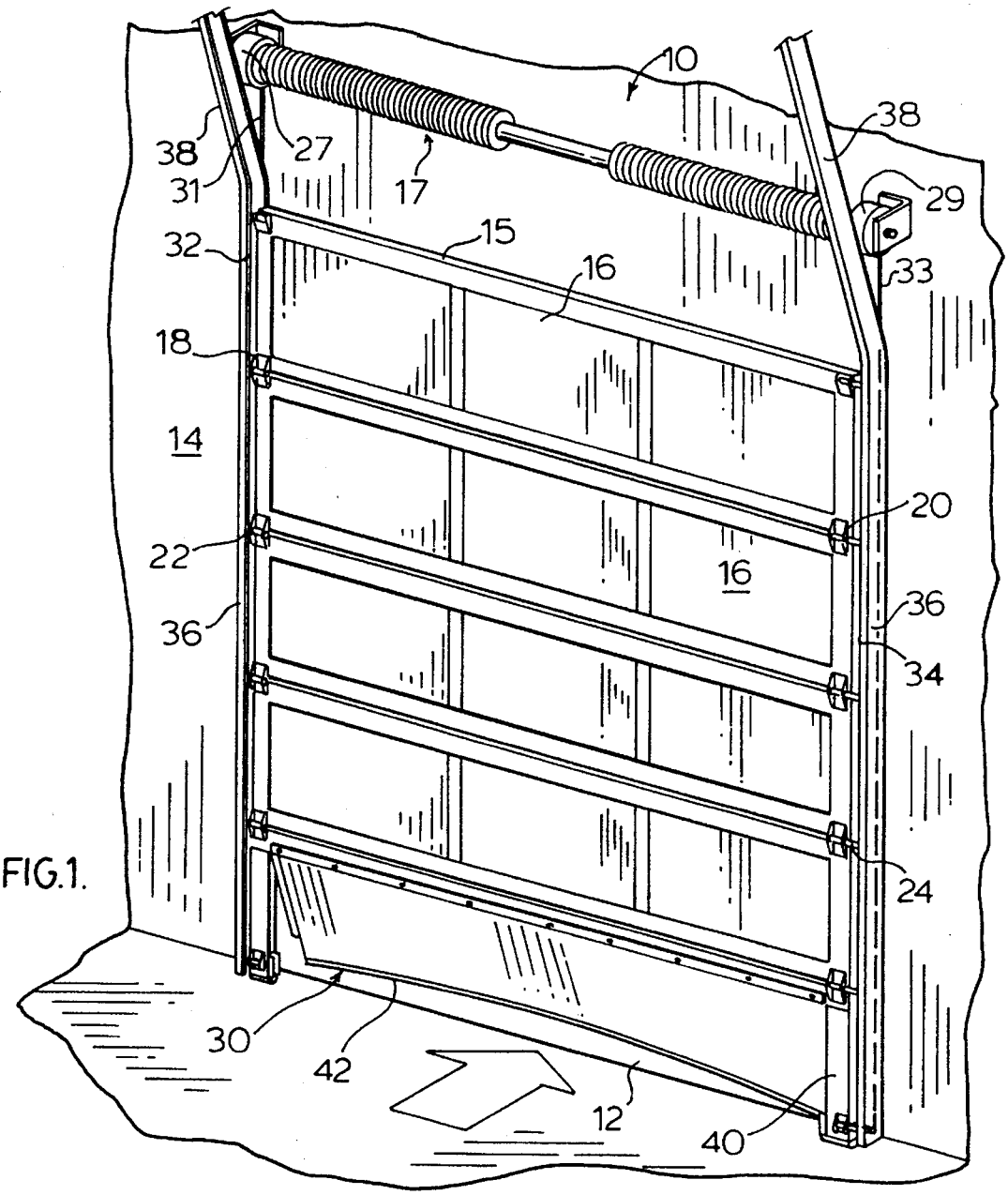
FIG. 1 is a perspective view of a door assembly of the invention, with the bottom panel swingingly displaced by an impact.
Figure 2:
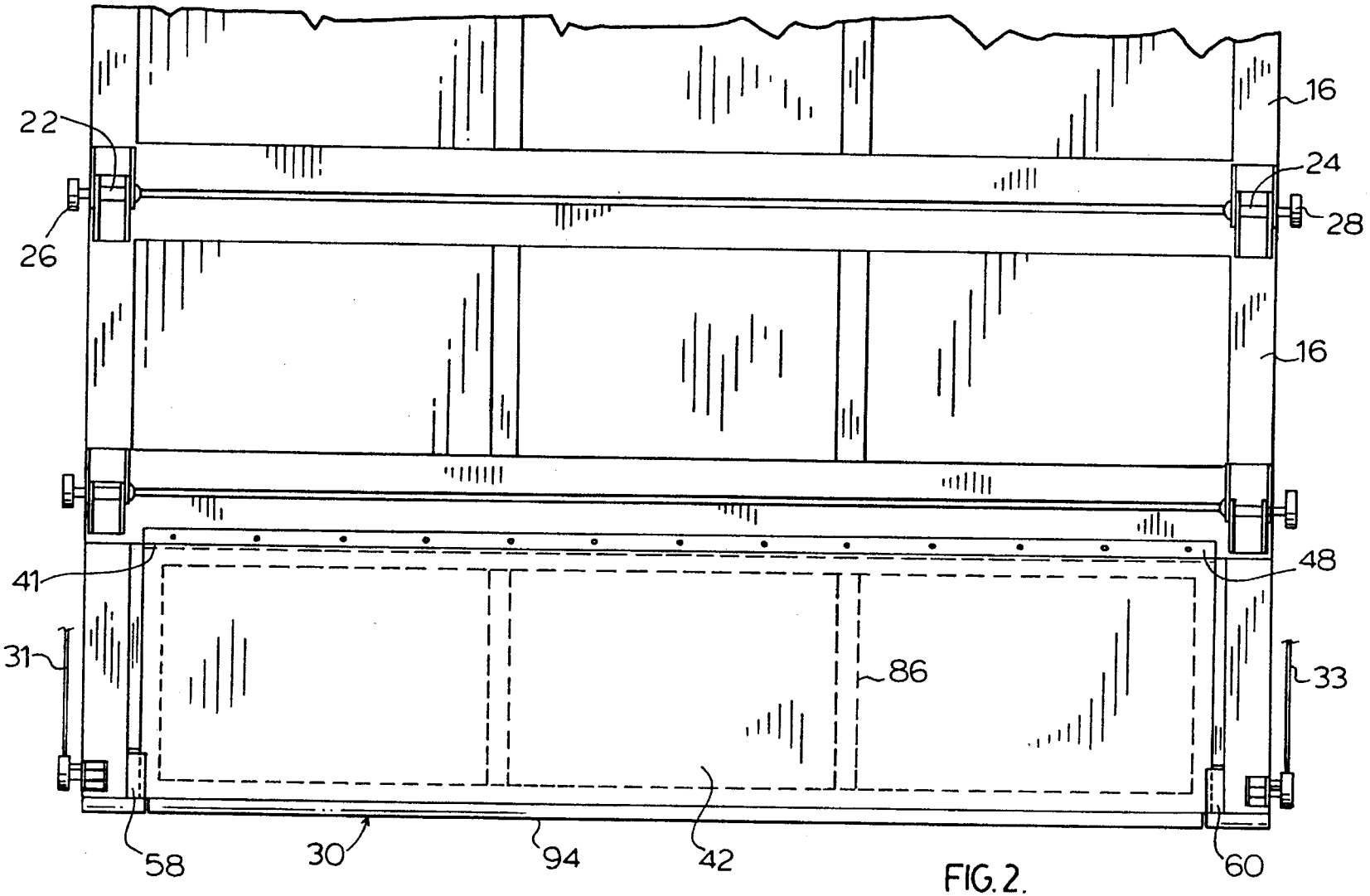
FIG. 2 is a front elevation of a lower part of a door in the assembly of FIG. 1.

With further reference to FIGS. 1 and 2, an overhead door assembly 10 is mounted in front of a door opening 12 in a wall 14.

Assembly 10 includes a door 15, a spring counter balance 17, cable drums 27 and 29, cables 31 and 33, cable posts or anchors 35 and parallel guide tracks 32 and 34. The cables 31 and 33 are secured at one end to the cable posts 35 on the door 15 and are wound around cable drums 27 and 29. This structure and its operation is conventional and is thus not described in detail here, furthermore, the invention does not reside in this structure.

Door 15 includes a plurality of rigid panels 16 in side-by-side relationship with hinges 18 and 20 flexibly coupling adjacent panels 16 of the plurality.

Associated with each hinge 18 is a roller spindle 22 and a roller 26 and associated with each hinge 20 is a roller spindle 24 and a roller 28.

Door 15 includes a bottom panel 30.

The guide tracks 32 and 34 have vertical sections 36 and inclined sections 38 which may merge with horizontal sections (not shown).

The door 15 may thus be moved along guide tracks 32 and 34 by means of rollers 26 and 28 and cables 31 and 33 between a closed position in which the door 15 is vertically disposed in front of door opening 12, and an open position in which door 15 is raised along the vertical sections 36 to the inclined sections 38 and possibly to the horizontal sections (not shown).

Figure 3:
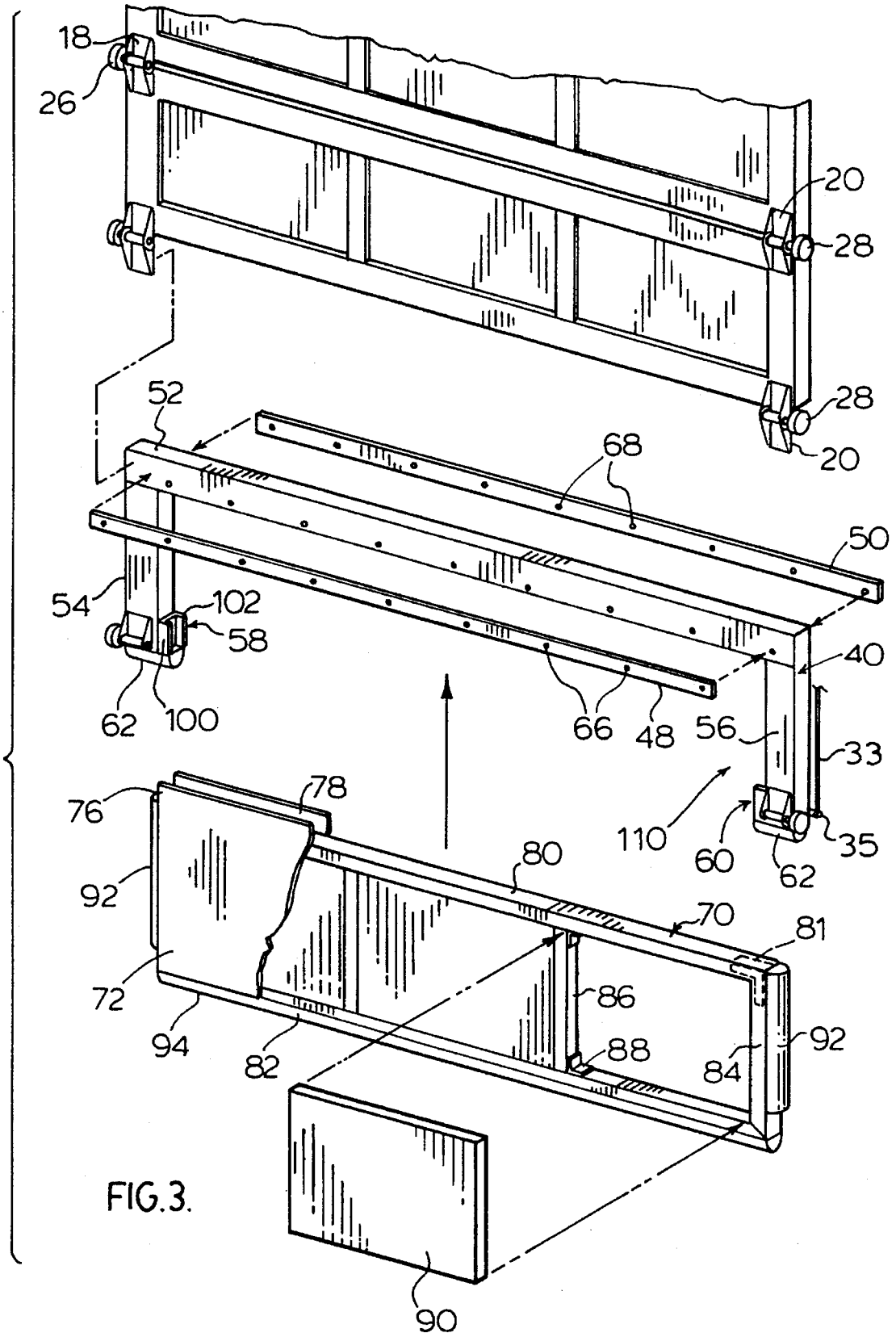
FIG. 3 is an exploded view of FIG. 2 showing the component parts of the bottom panel.

With additional reference to FIG. 3 there is shown an exploded view of the lower part of door 15 including the bottom panel 30.

In particular, bottom panel 30 includes an outer frame 40 and a swingable panel 42, which is hingedly mounted at flexible hinge 41, to outer frame 40 by a front mounting retaining strip 48 and a rear mounting retaining strip 50.

Outer frame 40 includes a horizontal top member 52 and vertical side members 54 and 56 extending downwardly from outer ends of horizontal top member 52, in opposed spaced apart relationship.

A retaining bracket 58 is mounted on an inner face of a lower end of side member 54 and a retaining bracket 60 is mounted on an inner face of a lower end of side member 56.

Bottom nose seals 62 extend downwardly from the side members 54 and 56.

Horizontal top member 52 has a plurality of front and rear mounting orifices 64; front mounting retaining strip 48 has a corresponding plurality of mounting orifices 66 and rear mounting retaining strip 50 has a corresponding plurality of mounting orifices 68.

Bottom roller retainers 44 and 46 are mounted on side members 54 and 56 for rollers 45 and roller spindles 47 of the bottom panel 30. The cable posts or anchors 35 are also mounted on side members 54 and 56.

Swingable panel 42 includes a semi-rigid frame 70, a front fabric panel 72 and a rear fabric panel 74. Front panel 72 has a front flap 76 and rear panel 74 has a rear flap 78.

Semi-rigid frame 70 has an upper frame member 80, a lower frame member 82 and side frame members 84, which together form a rectangular frame. Intermediate spacers 86 extend between upper and lower frame members 80 and 82 respectively. Reinforcing corner inserts 81, which may be, for example, of cast aluminium are located at the corners of frame 70. Thus, for example, a corner insert 81 has one arm telescoped within upper frame 80 and a second arm telescoped within a side frame 84 (See FIG. 3).

Assembly of the frame members 80, 82 and 84 and the spacers 86 can be by any convenient means. The corner inserts 81 are inserted between the upper and lower frame members 80 and 82, and the side frame members 84, this provides reinforcement at the corners of frame 70. There may be employed L-shaped connecting members 88 as shown in FIG. 3 between a spacer 86 and lower frame member 82. Mechanical connections such as nut and bolt connections or rivets may be employed between the arms of the L-shaped connecting members 88 and the adjacent components of the rectangular frame such as the spacer 86 and the lower frame member 82 as shown in FIG. 3, or a weld or chemical bond may be developed between the frame members and the L-shaped connecting members 88. In a preferred embodiment in which the frame members 80, 82 and 84 and the spacers 86 are hollow plastic pipes of rectangular cross-section, the weld with the L-shaped connecting members which will also be plastic, will be a plastic weld.

Foam inserts 90 are seated within frame 70 between the frame members 80,82 and 84 and the spacers 86; alternatively foam may be injected into the cavities defined between frame members 80, 82 and 84 and the spacers 86.

Gaskets 92 are secured such as by adhesive to the outer end faces of side frame members 84 and a nose seal 94 is secured, for example, by adhesive, to the lower face of lower frame member 82.

Figure 5:
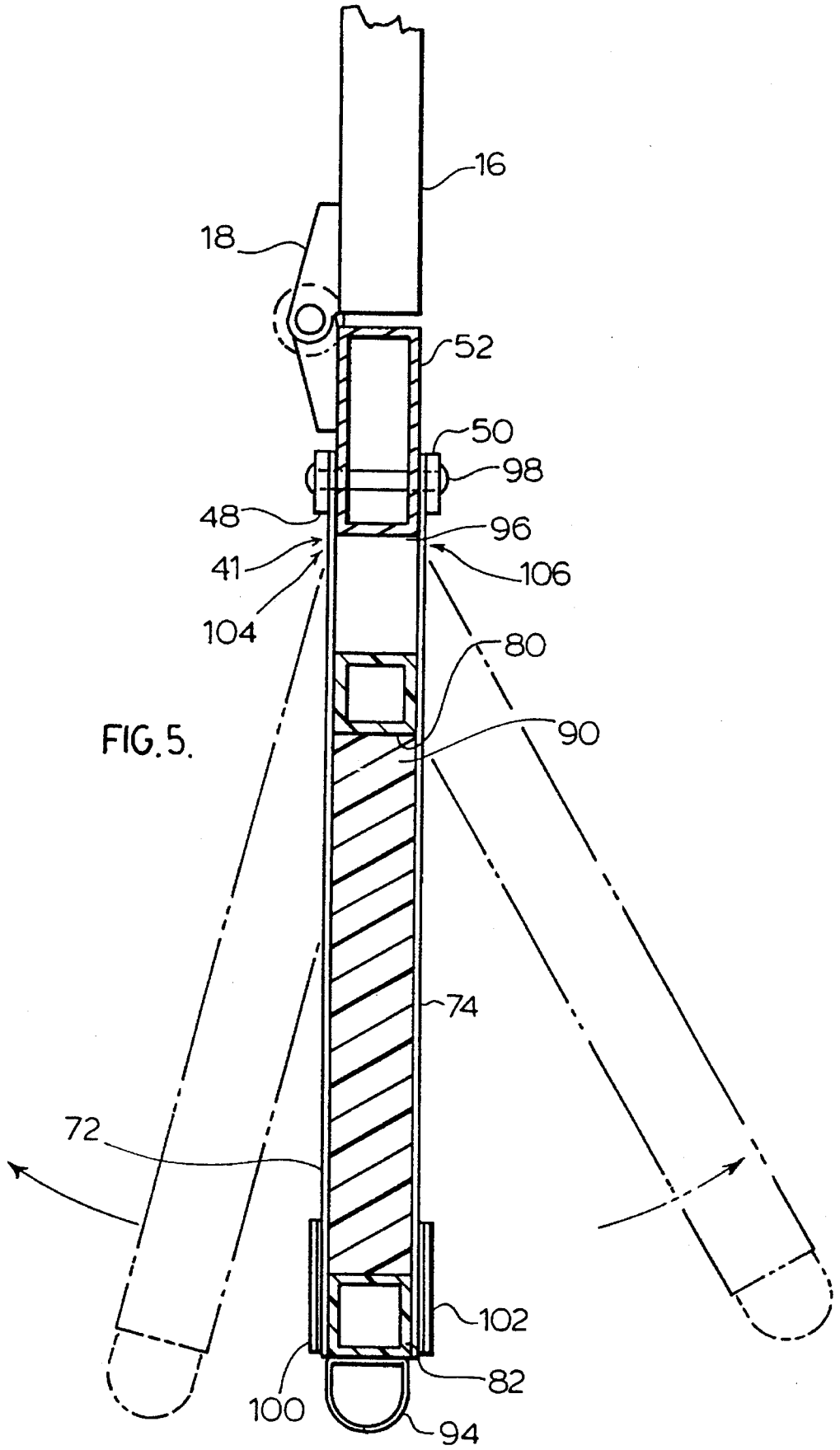
FIG. 5 is a side elevation, in cross-section of the bottom panel coupled to an adjacent rigid panel, illustrating swinging movement of the bottom panel in released configuration.

With particular reference to FIG. 5, a hinge gap or space 96 is defined between the upper face of semi-rigid frame 70 and the lower opposed face of the horizontal top member 52 of outer frame 40.

In assembling the bottom panel 30 it can be seen particularly from FIGS. 3 and 5 that the front and rear flaps 76 and 78 respectively, extend beyond upper frame member 80 of semi-rigid frame 70 and are secured to horizontal top member 52 of outer frame 40 by the front and rear mounting retaining strips 48 and 50 respectively with mounting elements 98 engaging the appropriate aligned orifices 66, 64 and 68. The mounting elements 98 may be any conventional mounting elements, for example, nut and bolt elements or rivets.

The flaps 76 and 78 have flap regions 104 and 106, respectively which are in opposed facing relationship and define flexible hinge 41 with hinge gap 96 therebetween.

The retainers 58 and 60, each have spaced apart retainer arms 100 and 102 which define a slot 108 for receiving and mating with a lower end corner of swingable panel 42.

The horizontal top member 52 and the side members 54 and 56 of outer frame 40 define a panel receiving slot 110 which matingly receives swingable panel 42. The gaskets 92 on the side frame members 84 of semi-rigid frame 70 engage the inner faces of side members 54 and 56 of outer frame 40 to close the panel slot 110.

Figure 4:
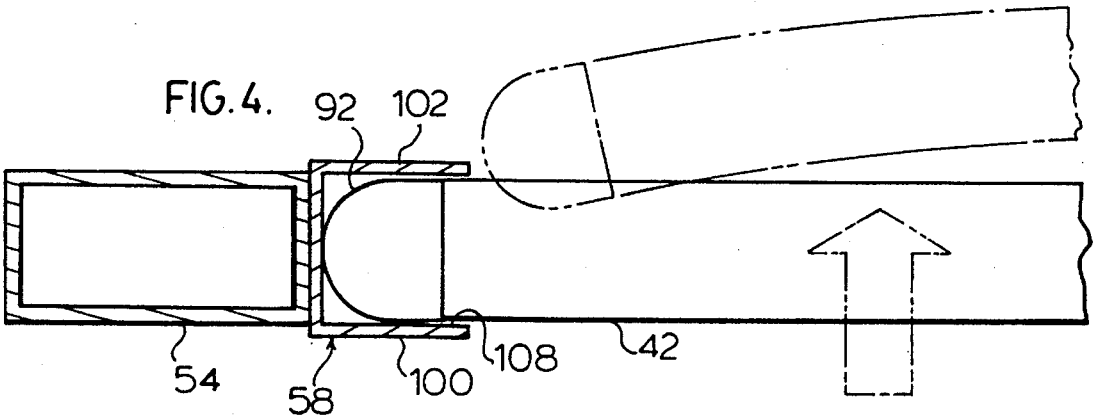
FIG. 4 is a schematic illustrating release of the bottom panel under impact.

The semi-rigid frame 70, as more particularly shown in FIG. 5 is suitably formed of plastic tubing of rectangular cross-section. Polyvinylchloride tubing has been found to be especially suitable. The tubing is, in particular, semi-rigid such that it will flex out of its normal plane in response to impact such that the side frame members 84 and 86 are drawn inward. Under application of a predetermined degree of the impact force the degree of flexing is such that swingable panel 42 is released from the brackets 58 and 60 whereafter the panel 40 is free to swing away from the impact force as illustrated in FIGS. 1, 4 and 5 where in FIGS. 1 and 4 the arrows identify the direction of the impact force and in FIG. 5 the arrows show the direction of swing of the panel 42 as a result of the application of the impact. On release of the impact force the semi-rigid frame is restored to its non-flexed rectangular configuration.

It will be recognized that during such swinging of the panel 42, the flap regions 104 and 106 adjacent hinge gap 96 will buckle.

Gap 96 suitably has a height, i.e., the distance between top member 52 and upper frame member 80, which is 1.5 times the overall thickness of panel 30. This allows for pivotal movement of panel 30 relative to the adjacent top member 52.

The flaps 76 and 78, particularly in flap regions 104 and 106, in conjunction with hinge gap 96, effectively provide a flexible hinge which can be distorted by buckling or flexing, both along a line parallel to the hinge axis, and also along lines perpendicular to such a line.

Thus the flexible hinge can buckle or flex in conjunction with the flexing of the semi-rigid frame 70, to accommodate the impact forces, during the build up of force prior to release of the panel 42 from the retaining brackets 58 and 60, along a line perpendicular to the hinge axis and after release of the panel 42 from the retaining brackets 58 and 60 can flex or buckle along lines parallel to the hinge axis to accommodate the swing of panel 42 away from the impact force.

On removal of the impact force the panel 42 swings back to a position engaging the arms 100 or 102 of the retaining brackets 58 and 60, and under manual pressure, again involving flexing of the semi-rigid frame 70, is snapped back into the retaining brackets 58 and 60 so that panel 42 is again seated in slots 108, to close panel slot 110.

Consequently it can be seen that the swingable panel 42 can accommodate impact forces applied thereto such as by a forklift truck crashing into or engaging swingable panel 42, the swingable panel 42 being released from outer frame 40 which remains secure in its engagement with guide tracks 32 and 34 so that no damage is incurred by the door assembly 10 including the spring counterbalance assembly 17, cable drums 27 and 29, cables 31 and 33 and guide tracks 32 and 34. After removal of the impact force the swingable panel is readily restored to its original position in panel slot 110.

The present invention thus provides a significant advantage over the structure described in the afore-mentioned U.S. Pat. No. 4,676,293 wherein the whole of the bottom panel including the attached hardware such as the rollers, is dislodged from the guide tracks.

It will be understood that the semi-rigid frame 70 is formed of materials which will provide an appropriate rigidity for the bottom panel 30, while at the same time having sufficient flexing characteristics that the semi-rigid frame 70 will flex for release of the panel 30 from retaining brackets 58 and 60.

It will further be understood that the arms 100 and 102 of retaining brackets 58 and 60 should be of dimensions sufficient to retain panel 42 within panel slot 110 under minor non-damaging impacts applied to panel 42, while permitting release of panel 42 when impacts of a predetermined size are experienced, which impacts would otherwise cause damage to door 15, in particular dislodging the bottom panel and potentially adjacent panels from the guide tracks with potential damage to the hardware such as hinges 18, rollers 26, roller spindles 22, counter balance assembly 17, cables 31 and 33 and guide tracks 32 and 34.

Suitably the panel 30 and the retaining brackets 58 and 60 are designed such that flexure of panel 30 occurs at non-damaging impacts typically of 0 to 50 lbs but at these impacts the panel 30 is retained by brackets 58 and 60; and at damaging impacts, typically about 50 lbs, the flexure is sufficient to release panel 30 from brackets 58 and 60.

Suitably for a panel 30 having a horizontal width of 8 feet, the interference overlap with the arms 100 and 102 of retaining brackets 58 and 60 is of the order of 0.375 inches.

It will further be recognized that hinge gap 96 must have a sufficient dimension to accommodate the pivotal or swinging movement of panel 42 and the change in position of upper frame member 80 relative to horizontal top member 52 during such swinging movement. The fabric of panels 72 and 74 is suitably a heavy duty fabric. The panels 72 and 74 are suitably glued to the front and rear faces of the frame 70 and the enclosed foam insert panels 90, and provide puncture resistance.

The heavy duty fabric may, for example, be a polyester fiber scrim impregnated on one side with PVC, available under the Trade Mark ALVEYOR 75 from Globe International.

The outer frame 40 is conveniently of aluminium.

The panel 30 may be incorporated in existing overhead door assemblies to replace an existing bottom panel or other panels. Further the panel 30 may be incorporated in an overhead door at the time of manufacture so that it is an original panel of the door.

The bottom panel 30 may suitably include a security device of conventional type so that the bottom panel 30 can be locked in outer frame 40 during non-working hours. Numerous of the conventional security devices available can be employed in bottom panel 30, for example, a slidable or retractable bolt mounted for movement relative to frame 70 to lockingly engage outer frame 40.

While the invention has been particularly described with reference to the embodiment in which the panel member of the invention is employed as the bottom panel of the door, it will be understood that any number of the door panels may be replaced by panel members of the invention.

Furthermore, while the invention has been particularly described by reference to an especially preferred embodiment which employs a bottom panel 30 having a semi-rigid frame 70 and a flexible hinge 41, which structure is simple and economic to produce, other embodiments are contemplated by the invention. Thus the panel 30 may have a non-flexing, relatively rigid frame 70 and a conventional mechanical hinge 41. In this case the retaining means might be, for example, an interference retainer having spring-loaded ball bearings between the outer frame 40 and the bottom panel 30, which ball bearings are released to permit pivotal movement of the panel 30, when subjected to high impact which would otherwise damage the door 15.

Furthermore, panel 30 may be constructed so that a lower portion away from hinge 41 is semi-rigid and will flex whereas an upper portion is inflexible or relatively inflexible so that ordinary non-flexible hinges may be employed.

It is especially appropriate to employ the panel member of the invention as at least the bottom panel of the door, since it is the bottom panel which is most often subject to accidental impact with forklift trucks or other warehouse vehicles, either in the lowered or raised configuration of the door, or during raising and lowering of the door.

We claim:

1. A panel member for use in an overhead door assembly adapted for movement between a closed position and an open position, on spaced apart parallel guide tracks, comprising:

an integral outer frame having a top member and a pair of side members extending downwardly from opposed ends of said top member, in opposed, spaced apart relationship, said top member and said side members together defining a panel receiving slot, said integral outer frame being adapted to be engaged in the guide tracks, panel means receivable in said panel receiving slot, hinge means hingedly mounting said panel means for pivotal movement relative to said integral outer frame, and retainer means on said integral frame to releasably retain the hingedly mounted panel means in said integral outer frame, said panel means being releasable from said retainer means in response to a predetermined impact, such that said panel means is released from said retainer means and is permitted to pivotally move about said hinge means, relative to said integral outer frame, while said integral outer frame remains engaged in the guide tracks.

2. A panel member according to claim 1, wherein said hinge means is a flexible hinge means.

3. A panel member for use in an overhead door assembly adapted for movement between a closed position and an open position, on spaced apart parallel guide tracks, comprising:

an integral outer frame having a top member and a pair of side members extending downwardly from opposed ends of said top member, in opposed, spaced apart relationship, said top member and said side members together defining a panel receiving slot, said integral outer frame being adapted to be engaged in the guide tracks, panel means receivable in said panel receiving slot, hinge means hingedly mounting said panel means on said integral outer frame, and retainer means on said integral outer frame to retain the hingedly mounted panel means in said integral outer frame, said panel means restorably flexing in response to impact, to release said panel means from said retainer means and permit pivotal movement of said panel means about said hinge means, relative to said integral outer frame, while said integral outer frame remains engaged in the guide tracks.

4. A panel member according to claim 3, wherein said hinge means is a flexible hinge means and said flexible hinge means and panel means restorably flex in response to impact, for said release of the panel means from the retainer means and pivotal movement of the panel means about the flexible hinge means.

5. A panel member according to claim 4, wherein said panel means comprises a panel having a semi-rigid frame which flexes in response to impact, said panel being matingly received in said panel-receiving slot; and said flexible hinge means comprises a flexible sheet material attached to said panel and to said integral outer frame.

6. A panel member according to claim 5, wherein said flexible sheet material is attached to said integral outer frame at said top member.

7. A panel member according to claim 6, wherein said semi-rigid frame is spaced from said top member to define a hinge gap, said flexible sheet material buckling at said hinge gap during swinging movement of said panel means about said flexible hinge means.

8. A panel member according to claim 7, wherein said flexible sheet material comprises front and rear portions defining front and rear faces of said panel, said front portion having a front upper flap attached to a front side of said top member and said rear portion having a rear upper flap attached to a rear side of said top member, opposed to said front side.

9. A panel member according to claim 8, wherein said retainer means comprises first and second brackets, mounted in opposed facing relationship on said side members of said outer frame, each bracket having a slot to matingly receive a lower corner of said panel, to restrain said panel against swinging movement about said flexible hinge means.

10. A panel member according to claim 9, further including a gasket between said side members and said semi-rigid frame.

11. A panel member according to claim 10, wherein said gasket is attached to said semi-rigid frame.

12. A panel member according to claim 8, wherein said panel further includes impact resistant foam material between said front and rear faces, within said semi-rigid frame.

13. A panel member according to claim 12, wherein said flexible sheet material is a heavy duty fabric and said semi-rigid frame has upper, lower and side frame members of polyvinylchloride semi-rigid tubing of rectangular cross-section.

14. A panel member according to claim 3, further including hinges on said integral outer frame to hingedly attach said panel member to a door panel of an overhead door assembly, and guide rollers on said integral outer frame for engagement with a guide track of an overhead door assembly.

15. An overhead door assembly adapted for movement between a closed position and an open position on spaced apart parallel tracks comprising:

a plurality of panels in side-by-side relationship, hinges between adjacent panels of said plurality, flexibly coupling adjacent panels, rollers associated with said panels and engaging said tracks, said panels including a bottom panel hingedly coupled to an adjacent panel, said bottom panel comprising:

an integral outer frame having a top member and a pair of side members extending downwardly from opposed ends of said top member, in opposed, spaced apart relationship, said top member and said side members together defining a panel receiving slot, said integral outer frame being adapted to be engaged in the guide tracks, panel means receivable in said panel receiving slot, flexible hinge means hingedly mounting said panel means on said integral outer frame and retainer means on said integral outer frame to retain the hingedly mounted panel means in said integral outer frame, said flexible hinge means and panel means restorably flexing in response to impact, to release said panel means from said retainer means and permit pivotal movement of said panel means about said flexible hinge means, relative to said integral outer frame, while said integral outer frame remains engaged in the tracks by its associated rollers.

16. An overhead door assembly according to claim 15, wherein said panel means comprises a panel having a semi-rigid frame which flexes in response to impact, said panel being matingly received in said panel-receiving slot; said flexible hinge means comprising a flexible sheet material attached to said top member, said semi-rigid frame being spaced from said top member to define a hinge gap, said flexible sheet material buckling at said hinge gap during swinging movement of said panel means about said flexible hinge means, relative to said integral outer frame.

17. An overhead door according to claim 16, wherein said retainer means comprises first and second brackets, mounted in opposed facing relationship on said side members of said outer frame, each bracket having a slot to matingly receive a lower corner of said panel, to restrain said panel against swinging movement about said flexible hinge means.

18. In an overhead door including a plurality of panels in which adjacent panels are flexibly coupled together for guidance along spaced apart, parallel guide tracks, the improvement wherein at least one of said panels comprises:

an integral outer frame having a top member and a pair of side members extending downwardly from opposed ends of said top member, in opposed, spaced apart relationship, said top member and said side members together defining a panel receiving slot, said integral outer frame being adapted to be engaged in the guide tracks, panel means receivable in said panel receiving slot, flexible hinge means hingedly mounting said panel means on said integral outer frame and retainer means on said integral outer frame to retain the hingedly mounted panel means in said integral outer frame, said flexible hinge means and panel means restorably flexing in response to impact, to release said panel means from said retainer means and permit pivotal movement of said panel means about said flexible hinge means, relative to said integral outer frame, while said integral outer frame remains engaged in the tracks.

19. A door according to claim 18, in which said at least one panel is a bottom panel of said door.

20. A door according to claim 19, wherein said panel means comprises a panel having a semi-rigid frame which flexes in response to impact, said panel being matingly received in said panel-receiving slot; said flexible hinge means comprising a flexible sheet material attached to said top member, said semi-rigid frame being spaced from said top member to define a hinge gap, and said flexible sheet material buckling at said hinge gap during swinging movement of said panel means about said flexible hinge means, relative to said integral outer frame; and wherein said retainer means comprises first and second brackets, mounted in opposed facing relationship on said side members of said outer frame, each bracket having a slot to matingly receive a lower corner of said panel, to restrain said panel against swinging movement about said flexible hinge means.

* * * * *